US008115791B2

(12) United States Patent
Vandermeulen et al.

(10) Patent No.: US 8,115,791 B2
(45) Date of Patent: Feb. 14, 2012

(54) TAPE PRINTING APPARATUS

(75) Inventors: Kris Vandermeulen, Bornem (BE); Erwin Vereecken, Stekene (BE)

(73) Assignee: DYMO, Sint-Niklaas (BE)

( * ) Notice: Subject to any disclaimer, the term of this patent is extended or adjusted under 35 U.S.C. 154(b) by 487 days.

(21) Appl. No.: 12/091,421

(22) PCT Filed: Oct. 24, 2006

(86) PCT No.: PCT/IB2006/003890

§ 371 (c)(1), (2), (4) Date: May 6, 2008

(87) PCT Pub. No.: WO2007/057779

PCT Pub. Date: May 24, 2007

(65) Prior Publication Data

US 2008/0259151 A1 Oct. 23, 2008

(30) Foreign Application Priority Data

Oct. 25, 2005 (GB) ..... 0521754.2

(51) Int. Cl.
*B41J 2/325* (2006.01)

(52) U.S. Cl. ..... 347/220; 347/109; 347/214; 347/215; 347/216; 347/217; 347/218; 347/219; 347/221

(58) Field of Classification Search ..... 347/109, 347/214–221
See application file for complete search history.

(56) References Cited

U.S. PATENT DOCUMENTS 5,222,818 A 6/1993 Akiyama et al.
5,424,757 A * 6/1995 Thom ..... 347/222
5,556,213 A 9/1996 Kudo et al.
6,190,065 B1 2/2001 Brzuskiewicz
7,315,317 B2 * 1/2008 Kitamura et al. ..... 347/171
2005/0053409 A1 3/2005 Akashi et al.

FOREIGN PATENT DOCUMENTS

EP 0 267 890 A2 5/1988
EP 0 487 313 A1 5/1992

(Continued)

OTHER PUBLICATIONS

Notice of Reasons for Rejection for Japanese Application No. 2008-537235, dated Sep. 6, 2011.

(Continued)

*Primary Examiner* — Ryan Lepisto
*Assistant Examiner* — Guy Anderson
(74) *Attorney, Agent, or Firm* — Marshall, Gerstein & Borun LLP

(57) ABSTRACT

A printing apparatus that receives a supply of an image receiving medium and includes a platen arranged to feed the image receiving medium selectively in one of a forward and reverse direction. A print head arranged to print an image on the image receiving medium while the medium is fed in the forward direction and an arcuate guide portion partially encasing the platen and movable relative to the surface of the platen. The guide portion having an inoperative position in which it is spaced from the print head to permit a supply of image receiving medium to be received and an operative position wherein the guide portion is moved to be proximate to the print head whereby the guide portion in the operative position restricts movement of the image receiving medium in a direction perpendicular to the forward and reverse direction.

19 Claims, 9 Drawing Sheets

FOREIGN PATENT DOCUMENTS

| | | | |
|---|---|---|---|
| EP | 0 514 155 | | 11/1992 |
| EP | 0 573 188 | | 12/1993 |
| EP | 0 634 275 | A2 | 1/1995 |
| EP | 0 641 663 | | 3/1995 |
| EP | 1 288 006 | | 3/2003 |
| EP | 1 580 007 | | 9/2005 |
| JP | 06-286241 | A | 10/1994 |
| JP | 2001-010183 | A | 1/2001 |
| JP | 2001-301258 | A | 10/2001 |
| JP | 2004-130656 | A | 4/2004 |
| JP | 2005-040960 | A | 2/2005 |

OTHER PUBLICATIONS

International Search Report for International Application No. PCT/182006/003890, dated Jun. 11.2007.

International Preliminary Report on Patentability for International Application No. PCT/IB2006/003890, dated Apr. 29, 2008.

* cited by examiner

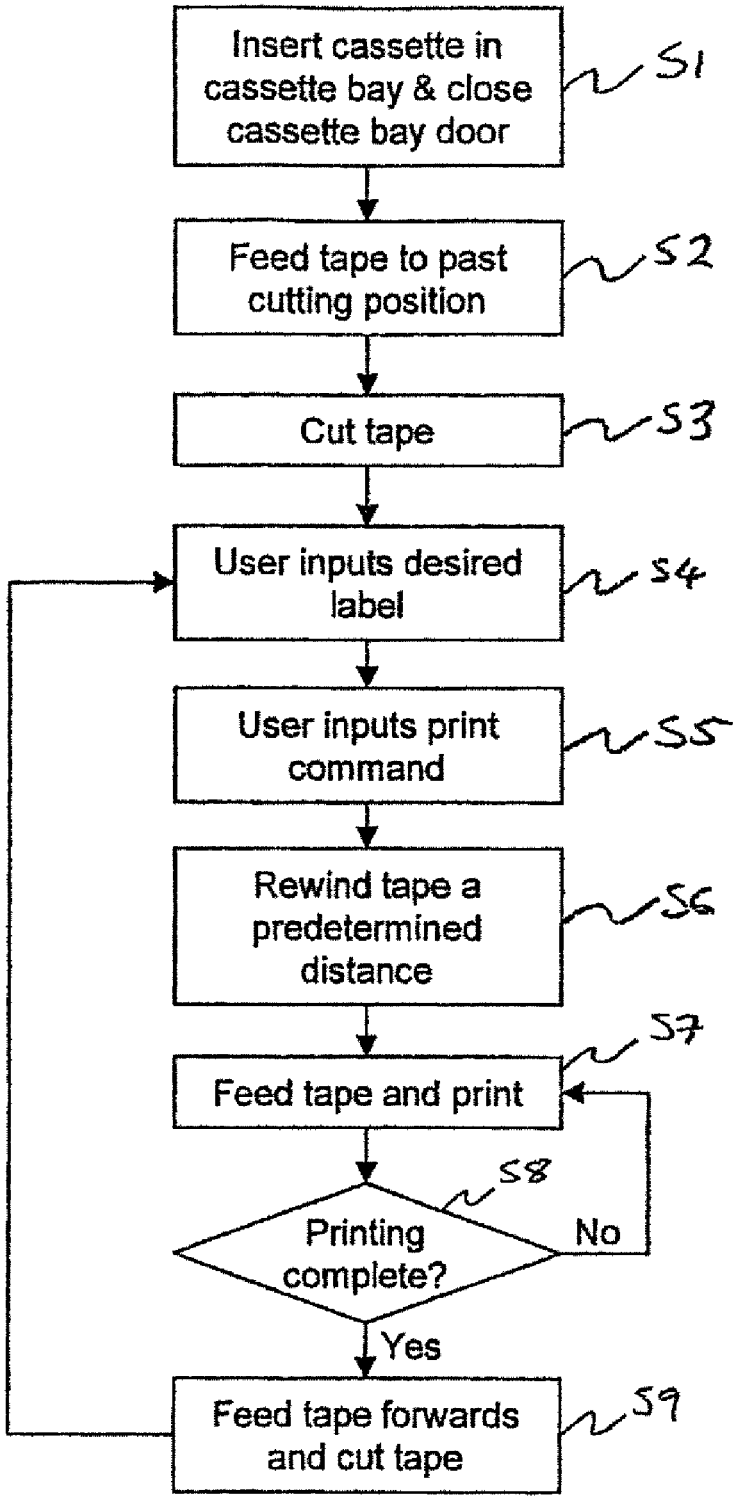
FIGURES

TAPE PRINTING APPARATUS

REFERENCE TO RELATED APPLICATIONS

This application is the United States national phase of international patent application PCT/IB2006/003890, and claims priority to United Kingdom patent application GB 0521754.2, filed Oct. 25, 2005.

FIELD OF THE DISCLOSURE

The present disclosure relates to tape printing apparatus.

BACKGROUND

Thermal printers of the type with which the present disclosure is concerned have been known for many years. They operate with a supply of tape arranged to receive an image and a means for transferring the image onto the tape. In one form, a tape holding case or cassette holds a supply of image receiving tape and a supply of an image transfer ribbon, the image receiving tape and transfer ribbon being passed in overlap through a printing zone of the printing device. An early printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releasable backing layer by a layer of adhesive. Once an image or message has been printed on the tape, it is desired to cut off that portion of the tape to enable it to be used as a label. For this purpose, it is necessary to remove the releasable backing layer from the upper layer to enable the upper layer to be secured to a surface by means of the adhesive layer. In EP-A-0267890 scissors are used to cut off the tape.

In a further printing device, described for example in EP-A-0487313 (Esselte Dymo N.V.), a tape holding case holds a supply of image receiving tape and a supply of image transfer ribbon, the image receiving tape having the same construction as described above with reference to EP-A-0267890. In this device, the cassette includes a feed roller which is rotatably mounted and which cooperates with an output roller of a printing device into which the cassette is inserted to feed the image receiving tape out of the printing device after printing has taken place. After the tape has been fed out of the cassette, the printed portion of the tape is cut off by a cutting mechanism located outside the cassette boundary.

In both of these devices, printing is carried out at a print location defined by a thermal print head and a platen against which the print head presses the image receiving tape and image transfer ribbon during printing. The image receiving tape is then fed past the print location by the feed mechanism comprising the feed roller of the cassette and the output roller of the printing device to a cutting mechanism located outside the cassette boundary.

During a printing operation of the type described above the tape is fed in a forwards direction, such that the tape moves from the print location towards the cutting mechanism and eventually outputs the tape printer. However, there may also be a requirement to feed the tape in a reverse direction, such that the tape moved from the cutting mechanism back towards the print location.

EP-A-0573188 (Esselte Dymo N.V.) describes a printing apparatus that is capable of printing an image on an image receiving tape which is wider than the print head. It does this by printing a lower part of a label on a wide image receiving tape, then rewinding the image receiving tape and raising the print head, and then printing an upper part of a label above the lower part. The tape is rewound using feed rollers and the rewound tape is fed back into the tape cassette. As this is rewinding the tape in order to repeatedly print over the same region of tape, the leading edge of the tape is never rewound further back than its initial location at the cutting mechanism. If the tape were to be rewound further, past the location of the cutting mechanism, then there is a risk that the tape would not relocate correctly in the region of the cutting means when it was subsequently fed forwards. This could result in the tape becoming jammed in the printer.

EP-A-0641663 (Brother) describes a tape printer which reverses the feeding direction of the tape. The tape can be rewound in order to allow the same part of the tape to be repeatedly printed. This is done in order to allow frames and embellishments to be added to a label, to repeatedly print the same text to produce a bold font, or to allow multicolour printing. In addition, the tape may be rewound to reduce the margins caused by the distance between the cutting mechanism and the print head. During a rewinding operation the platen and the print head are separated, and the tape is rewound back onto the tape spool whilst being fed by feed rollers located in a downstream direction of the print location. However, the tape can only be rewound a maximum distance, such that the leading edge of the tape is still located between the feed rollers. If the tape were to be rewound further, then it could not be subsequently fed forwards by the feed rollers, and the tape would become jammed in the printer. This limit on the rewind distance means that the margins on the printed label can only be reduced to a minimum size, corresponding to the distance between the feed rollers and the printing head.

It can therefore be seen that known printers that rewind the image receiving tape are limited in the extent to which the tape may be rewound, due to the risk of the tape becoming jammed when it is subsequently fed forwards. There is therefore a requirement for a printing apparatus that can reliably rewind the tape such that the leading edge is close to the print location, without risking subsequent jamming.

SUMMARY

The present disclosure seeks to provide a printing apparatus capable of feeding image receiving tape in a reverse direction and preventing subsequent jamming of the image receiving tape.

According to one aspect of the present disclosure, there is provided a printing apparatus comprising:

- A receiving area configured to receive a supply of an image receiving medium;
- a platen arranged to feed the image receiving medium selectively in one of a forward and reverse direction;
- a print head arranged to print an image on the image receiving medium while the medium is fed in the forward direction; and
- an arcuate guide portion partially encasing the platen and movable relative to the surface of the platen, said guide portion having an inoperative position in which it is spaced from the print head to permit a supply of image receiving medium to be received, and an operative position wherein the guide portion is moved to be proximate to the print head, whereby the guide portion in the operative position restricts movement of the image receiving medium in a direction perpendicular to the forward and reverse direction.

The image receiving medium may be continuous tape or die-cut labels. The printing may be performed by thermal transfer using an image transfer ribbon, or by using direct thermal image receiving medium.

Preferably, the arcuate guide portion extends substantially the whole length of the platen, and has an edge from which protrudes an extension piece which in the operational position is proximate to the printhead.

Preferably, the receiving means comprises a door movable between an open position in which the supply of an image receiving medium can be inserted into the receiving means and a closed position in which the door covers the receiving means.

Preferably, the arcuate guide portion comprises a rib mounted on the outside of the guide portion, said rib being arranged to be actuated by the door, whereby moving the door into the closed position moves the arcuate guide portion into the operative position.

Preferably, the arcuate guide portion is connected to a biasing means arranged to bias the guide portion in the inoperative position.

In one embodiment, the receiving means is a cassette receiving bay for receiving a cassette housing image receiving medium.

In another embodiment, the receiving means comprises first and second receiving zones for receiving respectively a image receiving medium holding case and an image transfer ribbon holding case.

In another embodiment, the cassette houses both image receiving medium and an image transfer ribbon. In another embodiment, the cassette houses direct thermal image receiving medium. In another embodiment, the image receiving medium is continuous tape. In another embodiment, the image receiving medium is die-cut labels.

According to another aspect of the present disclosure, there is provided a medium holding case for a thermal printer holding a supply of image receiving medium, the medium holding case having an outlet through which the image receiving medium can be fed out in a forward direction, a recess for accepting a print head, and a support member mounted on a wall of the medium holding case and extending inwardly of the recess and aligned with the outlet, whereby, when the medium holding case is located in a thermal printer, said support member supports a leading edge of the image receiving medium to restrict movement of the image receiving medium in a direction perpendicular to the forward direction such that the leading edge of the image receiving medium is located in the outlet when fed forwards.

Preferably, the medium holding case holds both a supply of image transfer ribbon and image receiving medium.

In another embodiment, the image receiving medium is a direct thermal medium. In another embodiment, the image receiving medium is continuous tape. In another embodiment, the image receiving medium is die-cut labels.

According to another aspect of the present disclosure, there is provided a printing apparatus comprising:

a receiving area for receiving a medium holding case;

a medium holding case located in said receiving area and holding a supply of an image receiving medium, the medium holding case having an outlet through which the image receiving medium can be fed out and a recess for accepting a print head; and a platen arranged to feed the image receiving medium selectively in one of a forward and reverse direction;

a print head arranged to print an image on the image receiving medium while the medium is fed in the forward direction;

an arcuate guide portion partially encasing the platen and movable relative to the surface of the platen, said guide portion having an inoperative position in which it is spaced from the print head to permit the medium holding case to be received, and an operative position wherein the guide portion is moved to be proximate to the print head, whereby the guide portion in the operative position restricts movement of the image receiving medium in a direction perpendicular to the forward and reverse direction.

Preferably, the medium holding case comprises a support member mounted on a wall of the medium holding case and extending inwardly of the recess and aligned with the outlet, whereby said support member supports a leading edge of the image receiving medium to restrict movement of the image receiving medium in a direction perpendicular to the forward direction such that the leading edge of the image receiving medium is located in the outlet when fed forwards.

According to another aspect of the present disclosure, there is provided a printing apparatus comprising:

means for receiving a supply of an image receiving tape and an image transfer ribbon;

a platen arranged to feed the image receiving tape and image transfer ribbon selectively in one of a forward and reverse direction;

a print head arranged to print an image on the image receiving tape while the tapes are fed in the forward direction, at least one of said platen and print head being movable from an inoperative position to an operative position in which the image receiving tape and image transfer ribbon are held between the platen and the print head; and a controller arranged to control the platen to feed the image receiving tape and image transfer ribbon in a reverse direction whilst in the operative position prior to a printing operation, thereby to reduce a leading amount of image receiving tape.

Preferably the printing apparatus further comprises a cutting means for cutting the image receiving tape after a printing operation.

In one embodiment the receiving means is a cassette receiving bay for receiving a cassette housing tape and ribbon. In another embodiment the receiving means comprises first and second receiving zones for receiving respectively a tape holding case and a ribbon holding case.

In another embodiment the controller is associated with a memory adapted to store a predetermined distance, and the controller is arranged to control the platen to feed the image receiving tape and image transfer ribbon in a reverse direction by said predetermined distance. In another embodiment the controller is arranged to control the platen to feed the image receiving tape and image transfer ribbon in a reverse direction a distance determined by the user of the printing apparatus. In another embodiment the controller is associated with a memory, said memory being adapted to store the distance determined by the user of the printing apparatus.

Preferably the printing apparatus comprises a platen motor connected to drive the platen and an encoder for monitoring the feed distance. Preferably the controller is a microcontroller.

According to another aspect of the present disclosure, there is provided a method of printing comprising the steps of:

feeding an image receiving tape and an image transfer ribbon in a reverse direction with the image receiving tape and image transfer ribbon held between a platen and a print head; then feeding the image receiving tape and image transfer ribbon in a forward direction while printing an image, with the image receiving tape and image transfer ribbon held between the platen and the print head.

Preferably, the method further comprises the step of cutting the image receiving tape after the printing operation and prior to the reverse feeding operation.

In another embodiment the image receiving tape and image transfer ribbon are fed in the reverse direction by a predetermined distance. In another embodiment the image receiving tape and image transfer ribbon are fed in the reverse direction by a distance determined by the user of a printing apparatus.

In another embodiment the method comprises the step of storing the predetermined distance in a memory. In another embodiment the method comprises the step of storing the distance determined by the user of the printing apparatus in a memory.

BRIEF DESCRIPTION OF THE SEVERAL VIEWS OF THE DRAWING

For a better understanding of the present disclosure and to show how the same may be put into effect, reference will now be made, by way of example, to the following drawings in which:

FIG. 3A shows a cassette bay of a reverse feeding tape printer in a closed position;

DETAILED DESCRIPTION OF THE PREFERRED EMBODIMENTS

Figure 1A:
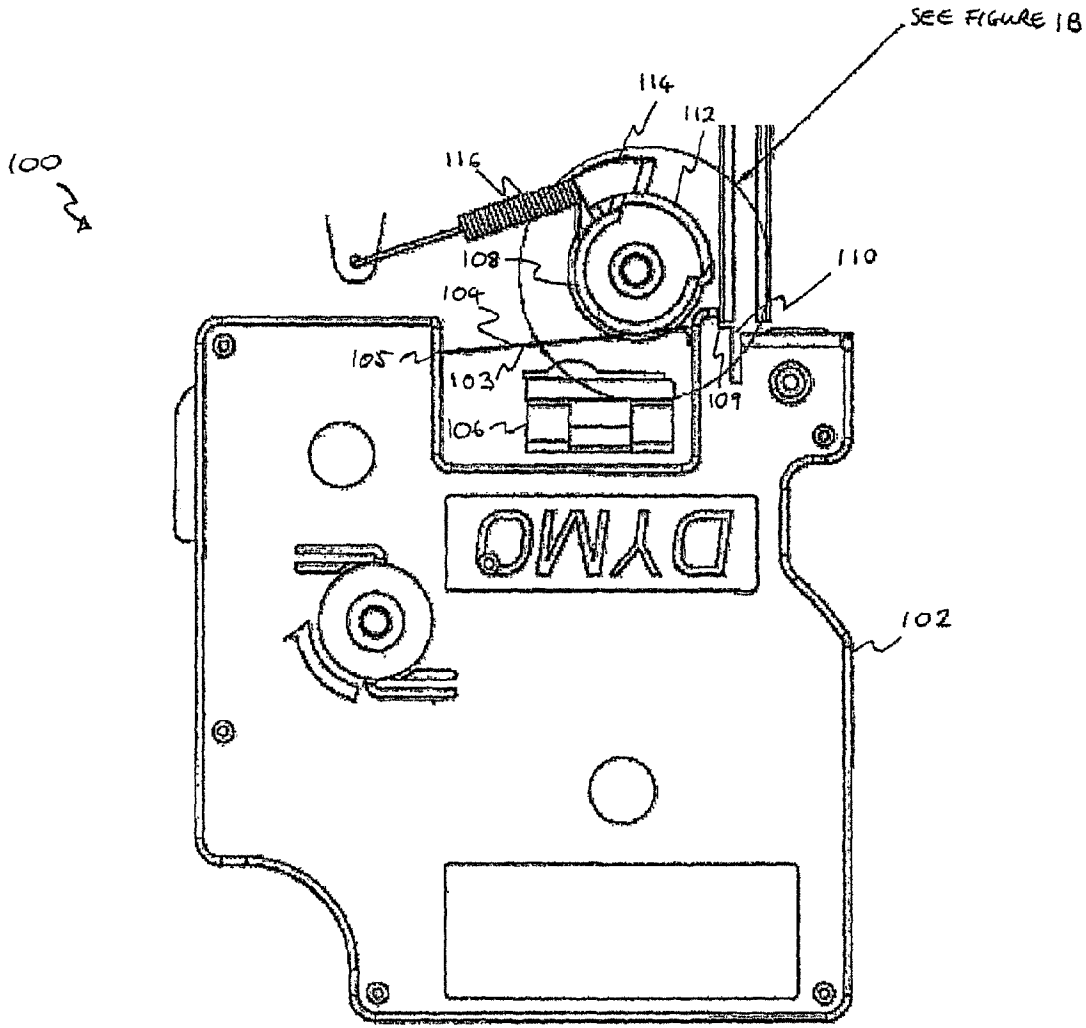
FIG. 1A shows a cassette bay of a reverse feeding tape printer in an open position.

Reference is first made to FIG. 1A, which shows the cassette bay 100 of a reverse feeding tape printer in an open position (such as with a cassette bay door open). FIG. 1A shows a cassette 102, which contains a reel of image receiving medium 104. In the embodiment shown in FIG. 1A, the image receiving medium is a continuous tape that has an upper layer for receiving an image on its upper surface and, on its lower surface, a layer of adhesive to which a releasable backing layer is secured. The tape is arranged so that the image receiving layer faces downwards in FIG. 1A. In alternative embodiments, the image receiving medium may comprise die-cut labels adhered to a continuous releasable backing layer.

In the embodiment shown in FIG. 1A a single cassette 102 contains both the image receiving tape 104 and also a supply of image transfer ribbon 103, which passes along the same path as the image receiving tape, and is below the image receiving tape 104 in FIG. 1A. In an alternative embodiment, the image receiving tape and the image transfer ribbon may be housed in separate cassettes, but it will be appreciated that the principles of reverse feeding discussed herein with reference to the cassette of FIG. 1A can also be applied to so-called "separate" cassette tape printers. In further alternative embodiments, the image receiving medium may be a direct thermal medium, in which case an image transfer ribbon is not present.

The image receiving tape and image transfer ribbon passes out of the cassette through an opening at 105, and then passes between a print head 106 and a platen 108 which form part of a printing and feeding mechanism and are mounted in the cassette bay of the printer. The print head 106 is pivotable, such that it can be brought into contact with the platen 108 for printing, or moved away to an open position, such that there is a gap between the platen 108 and the print head 106 to permit the cassette to be inserted into and removed from the printer. In FIG. 1A the print head 106 is shown in an open position.

After passing between the print head 106 and the platen 108, the image transfer ribbon 103 then passes back into the cassette. The image receiving tape outputs the cassette at opening 109. A slot 110 is formed in the cassette 102, such that image receiving tape passing over the slot may be cut by a cutting blade (not shown) to produce a label, as described previously.

During a printing operation, the platen 108 is driven so that it rotates to feed the image receiving tape 104 and image transfer ribbon 103 in a forward direction past the print head 106. The print head 106 comprises a column of printing elements which, when activated, cause ink to be transferred from the image transfer ribbon to the image receiving tape so that an image is transferred onto the image receiving tape 104 on a column-by-column basis as the tapes are fed in a forward direction by the rotation of the platen 108.

Figure 1B:
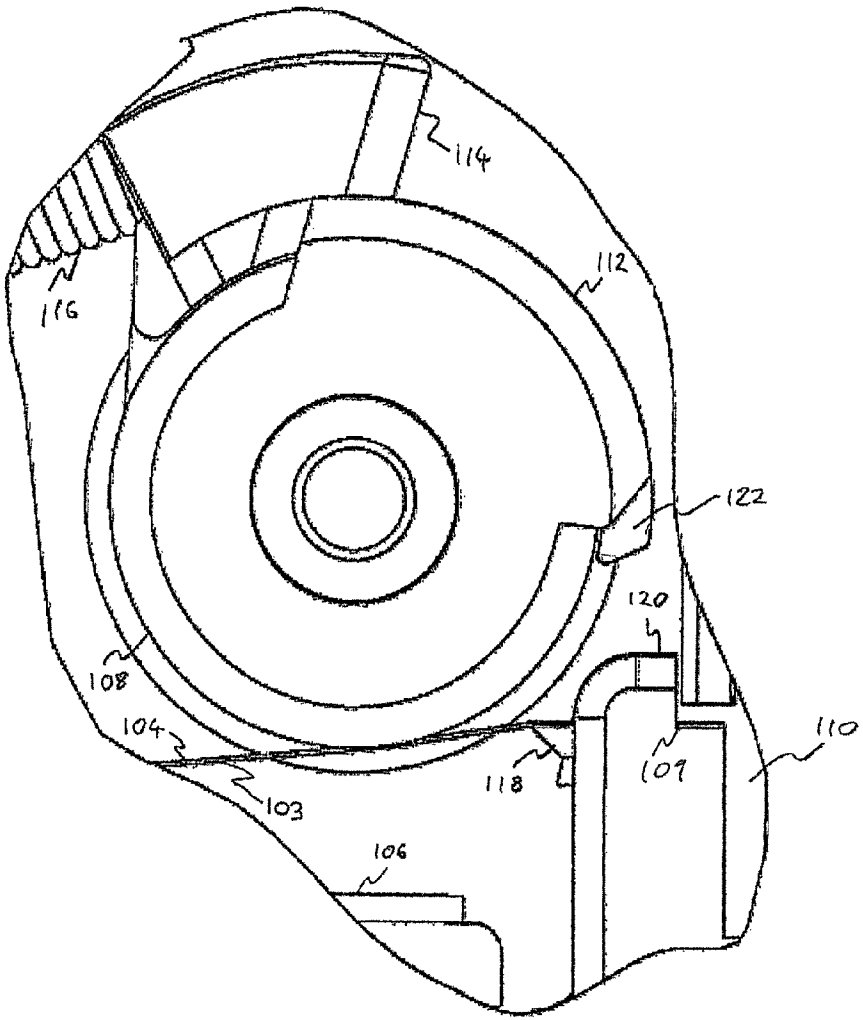
FIG. 1B shows a close-up view of the platen of FIG. 1A.

Reference is now made to FIG. 1B, which shows a close up view of the platen 108 of FIG. 1A. Mounted around the outside of the platen 108 is a rotatable tape guide 112, which is arranged to rotate around the axis of the platen, but independently of the platen's rotation. The rotatable tape guide 112 is biased anti-clockwise in FIG. 1B by a return spring 116. The biasing of the rotatable tape guide by the return spring 116 places the rotatable tape guide in an open position, such that there is a gap between a guiding portion 122 of the rotatable tape guide and the edge of the cassette. This permits the cassette to be inserted into the printer.

Figure 2B:
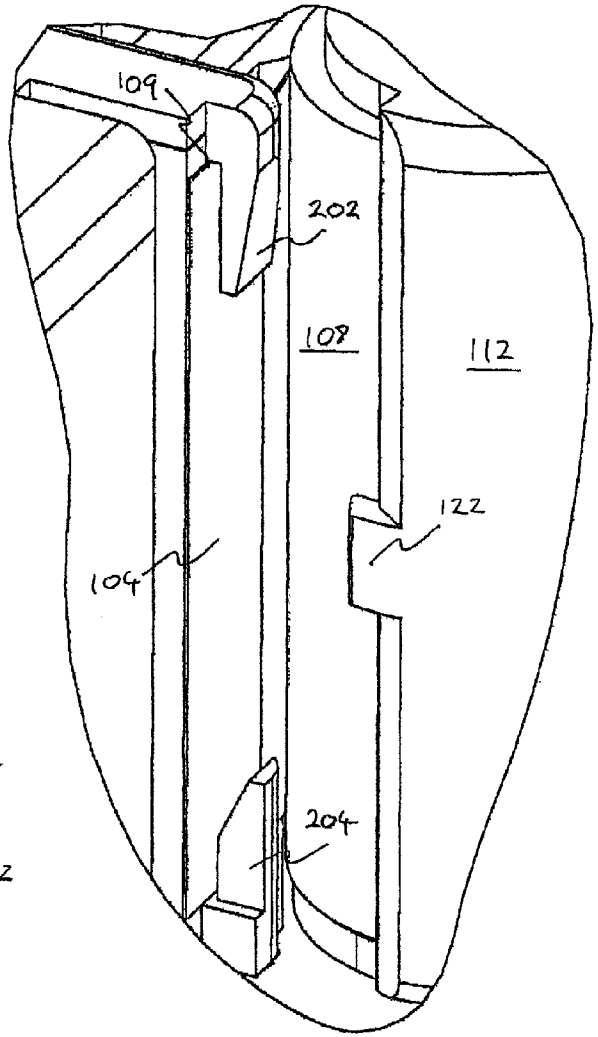
FIG. 2B shows a close-up view of the platen of FIG. 2A.
Figure 2A:
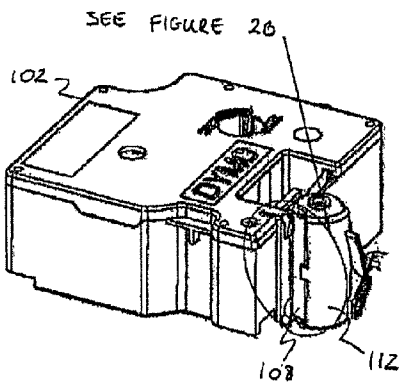
FIG. 2A shows a side view of a cassette bay of a reverse feeding tape printer in an open position.

Mounted on the cassette 102 is a guide rib 118, the function of which will be described in more detail hereinafter. Also mounted on the side of the cassette in the area labelled 120 are tape guide pins, which can be seen more clearly with reference to FIGS. 2A and 2B. FIG. 2A shows a side view of the cassette and platen assembly of FIG. 1A. A close-up view of the platen 108 and the image receiving tape output 109 is shown in FIG. 2B. At the image receiving tape output opening 109 the image receiving tape 104 passes between two tape guide pins 202 and 204. These tape guide pins 202 and 204 retain the image receiving tape close to the cassette body, to ensure that the image receiving tape passes accurately over the slot 110 for the cutting blade. FIG. 2B also clearly shows the structure of rotatable tape guide 112, and in particular the guiding portion 122.

Figure 3B:
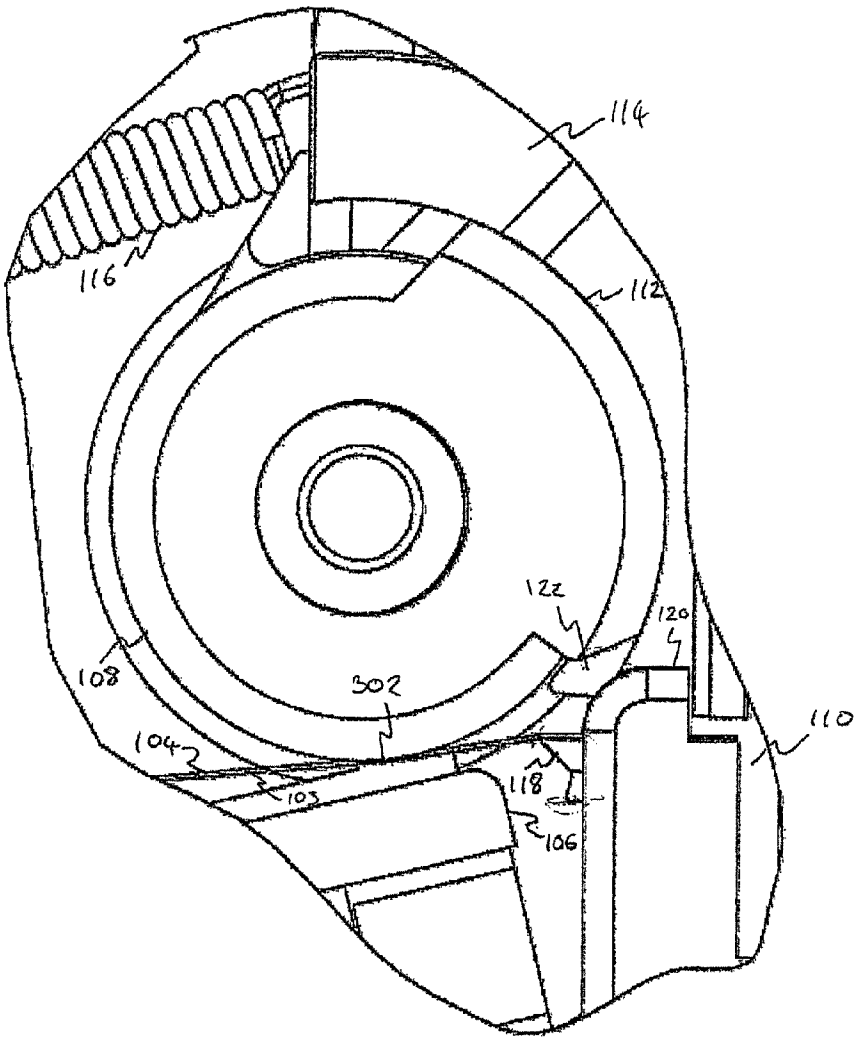
FIG. 3B shows a close-up view of the platen of FIG. 3A.

Reference is now made to FIG. 3A, which shows the cassette bay 100 of a reverse feeding tape printer in a closed position (such as with the cassette bay door closed) and ready to print. In particular, it can be seen in FIG. 3A that the print head 106 has been pivoted such that it is now making contact with the image receiving tape 104, which is in turn in contact with the platen 108. This can be seen more clearly with reference to FIG. 3B, which shows a close-up view of the platen area of FIG. 3A. FIG. 3B shows the image receiving tape 104 making contact with both the print head 106 and the platen 108 at 302. In this position, the platen 108 is able to feed the image receiving tape and the print head 106 can print an image onto the image receiving tape, as described earlier.

It can also be seen from FIGS. 3A and 3B that the rotatable tape guide 112 has been rotated clockwise. This rotation has brought the guide portion 122 to within close proximity of the image receiving tape 104. In the embodiment shown in FIG. 3B, the guide portion is approximately 1 mm away from the tape. The rotatable tape guide 112 has been rotated by a rib on the cassette bay door (not shown), which presses downwards on a diagonally mounted strip 114. As the cassette bay door is closed, downwards pressure is applied to the diagonally mounted strip 114 by the rib on the cassette bay door, which acts to rotate the rotatable tape guide clockwise, extending the return spring 116.

Figure 4B:
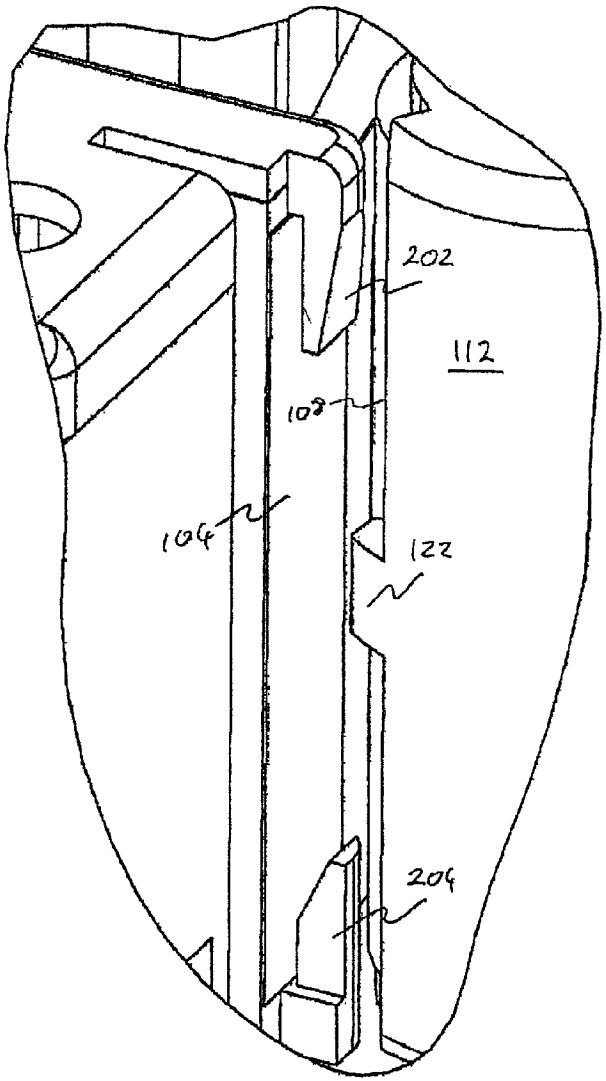
FIG. 4B shows a close-up view of the platen of FIG. 4A.
Figure 4A:
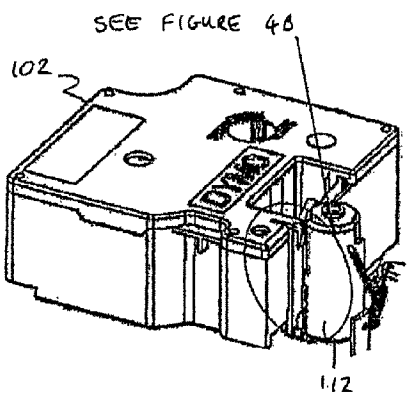
FIG. 4A shows a side view of a cassette bay of a reverse feeding tape printer in a closed position.

FIGS. 4A and 4B show a side view of the cassette 102 and rotatable tape guide 112 in the closed position. This shows how the rotatable tape guide 112 has been rotated around the platen 108 to bring the guide portion 122 close to the image receiving tape 104.

Figure 5A:
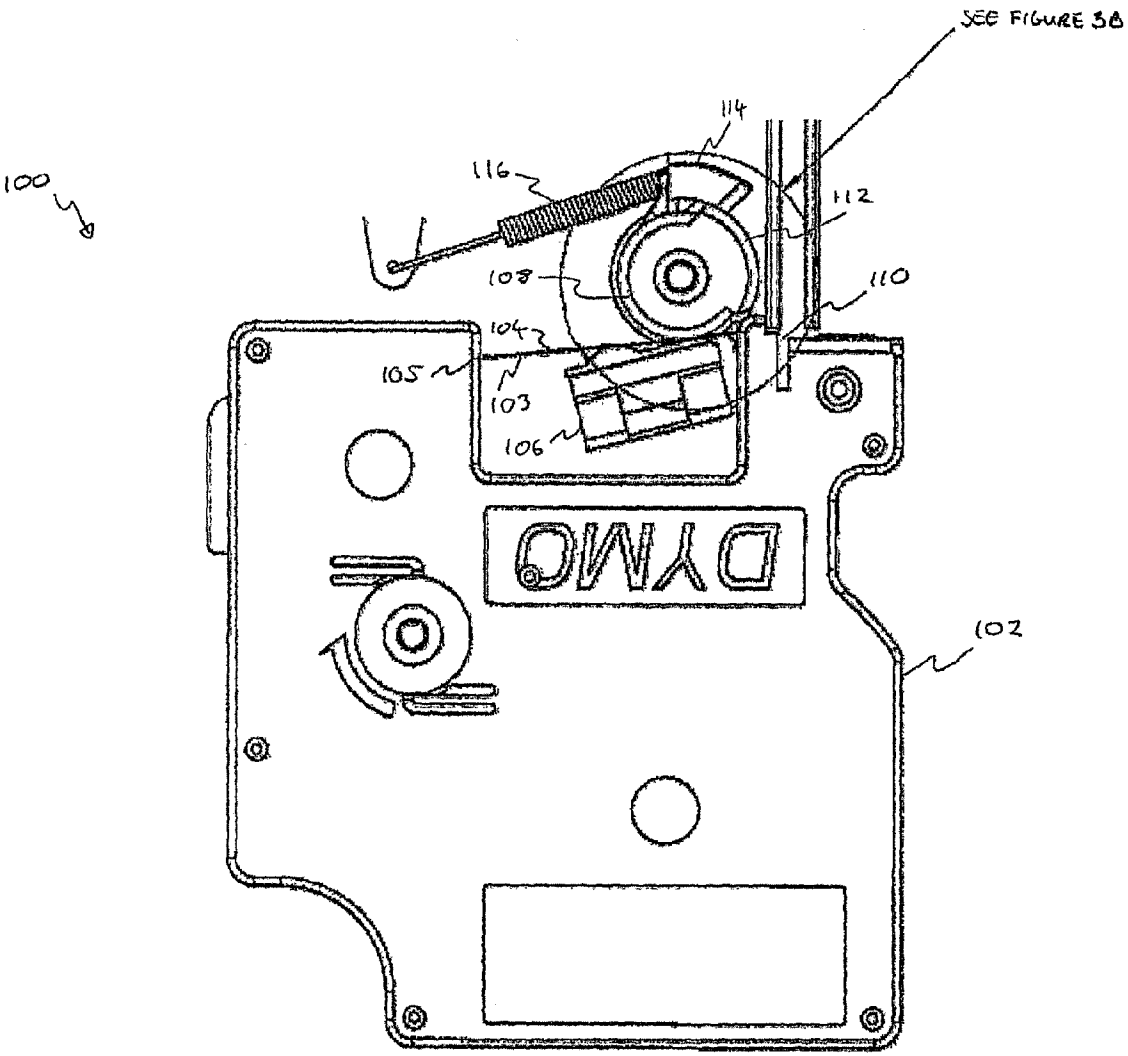
FIG. 5 shows a flowchart describing a reverse feeding operation.

Reference is now made to FIG. 5, which shows a flowchart describing the reverse feeding operation. The first step in the operation, step S1, is to insert a cassette 102 into the cassette bay 100. This is done by opening the cassette bay door. Opening the cassette bay door releases the rotatable tape guide 112, as the rib on the cassette bay door is no longer applying pressure to the diagonal strip 114. The return spring 116 then pulls the rotatable tape guide 112 anticlockwise preventing the cassette insertion from being impeded by the rotatable tape guide 112. The print head 106 is also pivoted away from the platen 108, permitting the cassette to be inserted. After inserting the cassette, but before closing the cassette bay door, the cassette bay will be in the situation depicted in FIG. 1A. When the cassette bay door is closed the rotatable tape guide 112 is rotated clockwise and the print head 106 is brought into contact with the image receiving tape 104 and platen 108. The cassette bay will then be in the situation depicted in FIG. 3A.

The initial print position then needs to be set by the printer. This is done in steps S2 and S3. These steps are required as when a cassette is first inserted the printer does not know precisely where the edge of the image receiving tape is. Firstly, at step S2, the tape is fed forwards a short, predetermined distance. The purpose of feeding the tape forwards is to ensure that regardless of where in the output region of the cassette the edge of the image receiving tape lies before feeding, that after the tape is fed forwards the edge lies downstream of the cutting position 110. The feeding of the image receiving tape is achieved by driving the platen 108 in a forward direction with the print head 106 biased against the image receiving tape.

At step S3 the image receiving tape is then cut by the cutting means at the slot 110 in the cassette. The printer then knows that the edge of the image receiving tape is located at the slot 110 in the cassette.

Following the cutting operation in step S3, the printer is in a position to print a label. This is performed at steps S4 to S8. The user inputs the label to be printed in step S4 and at step S5 the user issues the command to print the label (for example by pressing the "print" button).

The image receiving tape is then rewound by a predetermined rewinding distance at step S6. The rewinding operation is performed by keeping the print head 106 biased against the image receiving tape 104 and the platen 108, and driving the platen in a reverse direction (clockwise as seen in FIG. 3A). During the rewinding operation both the image receiving tape 104 and the image transfer ribbon 103 are rewound. Using the platen 108 to rewind the tape will cause some slack to be produced in the tape upstream from the platen 108. However, the rewinding distance that the tape is rewound is small compared to the length of tape between the contact point 302 of the image receiving tape 104 and the print head 106, and the opening 105 in the cassette 102. Therefore, the printer is easily able to accommodate the slack produced without the need to wind the image receiving tape 104 back into the cassette 102.

The rewinding distance that the image receiving tape is rewound may be determined in a number of ways. In one embodiment, the rewinding distance that the image receiving tape is rewound may be fixed in the printer. This rewinding distance may be based on the known distance between the point at which the cutting means cuts the image receiving tape and the end of the guide rib 118 (for reasons to be explained presently). Alternatively, in another embodiment, the user may be able to set a rewind distance in order to determine the margins that are seen on the printed label. However, the user determined rewind distance needs to be limited to a maximum rewind distance corresponding to the known distance between the point at which the cutting means cuts the image receiving tape and the end of the guide rib 118.

It will be noted, however, that following the rewinding operation in step S6 the image receiving tape may no longer be located within the tape guide pins 202 and 204, as the edge of the image receiving tape has been rewound to a position upstream of the tape guide pins 202 and 204. This poses a problem, as it must be ensured that the image receiving tape is relocated between these pins as it is fed forwards, to prevent the image receiving tape becoming jammed in the tape printer.

This problem is solved by the tape guide rib 118 and the rotatable tape guide 112. With reference again to FIG. 3B, the tape guide rib 118 prevents the rewound image receiving tape from dropping vertically downwards (as viewed in FIG. 3B). In particular, the guide rib 118 prevents the rewound image receiving tape from being unsupported downstream of the platen 108 and print head 106. Without the guide rib 118, the image receiving tape could drop vertically downwards and be deflected by the wall of the cassette 102 when fed by the platen 108, rather then being guided back between the guide pins 202 and 204. This is the reason why the guide rib 118 determines the maximum rewinding distance that the image receiving tape may be rewound. The image receiving tape may be rewound back from the cutting position to a maximum position of the end of the guide rib 118. If the image receiving tape were to be rewound any further than this then it would be unsupported, and a tape jam would be likely.

The other problem that the image receiving tape faces as it is fed forwards by the platen 108 after rewinding is that the image receiving tape may be fed too far vertically upwards (as viewed in FIG. 3B) and would not relocate between the guide pins 202 and 204. If this were to occur, then the image receiving tape would not exit from the printer and a tape jam would occur. This problem is solved by the rotatable tape guide 112. As shown in FIG. 3B, when the rotatable tape guide 112 is in the closed position, the guide portion 122 is located vertically above and close to the image receiving tape. The guide portion 122 deflects the tape and prevents it being fed too far vertically upwards. In this way, the rotatable tape guide 112 ensures that the image receiving tape is fed back between the guide pins 202 and 204 as it is fed forwards by the platen.

Returning to FIG. 5, at step S7 the printing of the label is started. The image receiving tape 104 is fed forwards by the platen 108 whilst the print head 106 transfers an image to the image receiving tape 104 at the contact point 302. The printing continues until it is determined at step S8 that the printing operation is complete. At step S9, the image receiving tape is fed forwards by the platen to the cutting position of the label, and the image receiving tape is cut to produce the label. The cutting may be performed by an automatic or a manual cutter.

Following cutting of the label, the control returns to step S4 and where the user can enter a new label. Further labels can then be printed as required.

In the embodiment of the disclosure shown in FIG. 3B the distance between the cutting position and the point where the printhead contacts the image receiving tape is approximately 8 mm. Therefore, the minimum leader length without reverse feeding is approximately 8 mm. However, the distance between the guide rib 118 and the point where the printhead contacts the image receiving tape is approximately 4 mm. Therefore, with the reverse feeding operation described above, the minimum leader length can be reduced to approximately 4 mm. The reverse feeding operation can obviously be used with other tape printer dimensions.

Figure 6:
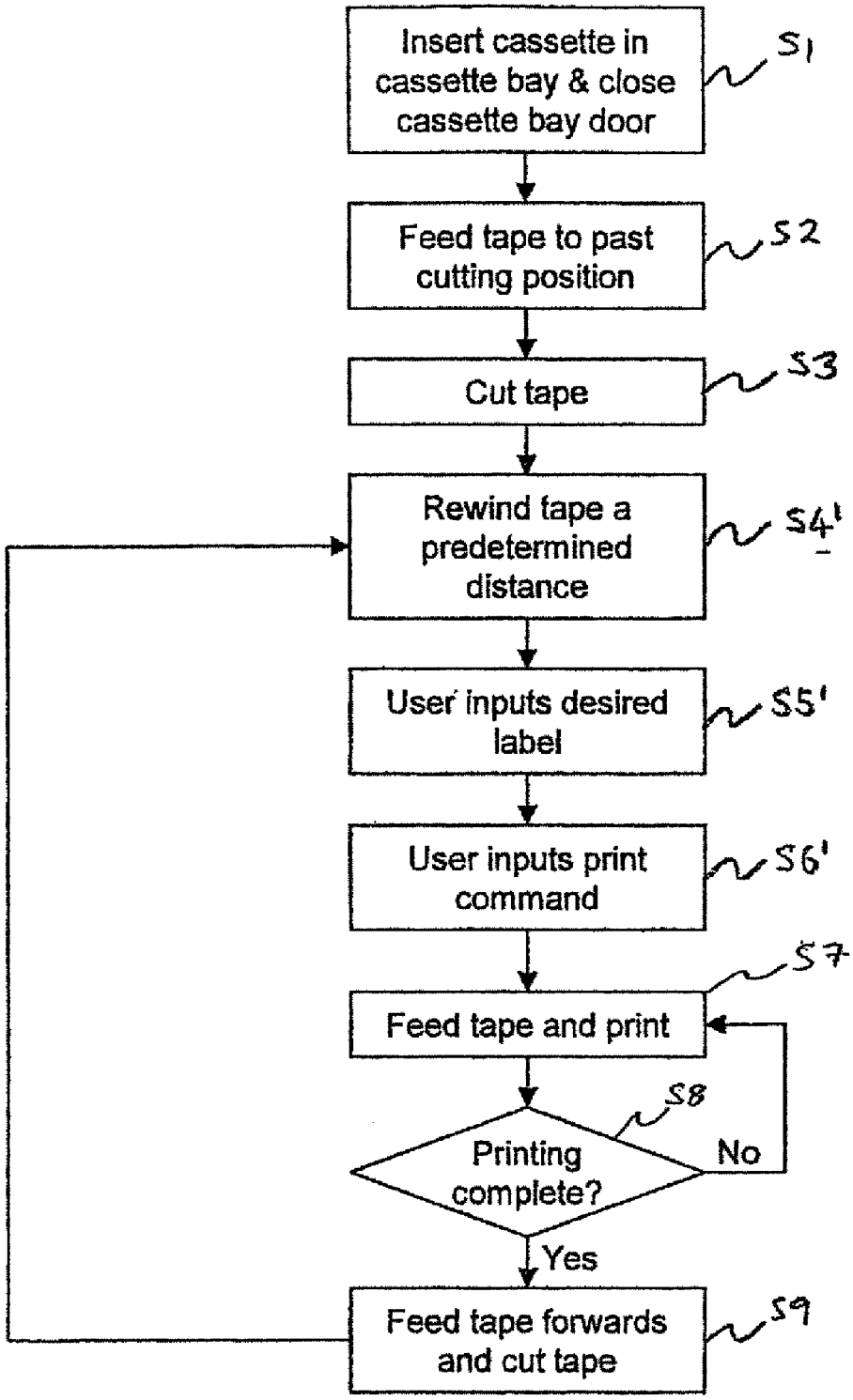
FIG. 6 shows a flowchart describing an alternative reverse feeding operation.

An alternative operation to that shown in FIG. 5 can be performed in the case that the printer comprises an automatic cutter or a manual cutter that has a sensor that can inform the printer when the cutting has been performed. This alternative operation is shown in FIG. 6. The first three steps for setting the initial printing position, steps S1-S3, are identical to those described with reference to FIG. 5, above. Following step S3, at step S4' the operation to rewind the tape a predetermined distance is performed. Step S4' is identical to step S6 discussed above with reference to FIG. 5. However, step S4' can be performed at this point in the operation as the printer knows when the cutting operation has been performed, and can therefore rewind the tape immediately afterwards.

At Step S5' the user enters the label to be printed (as described for step S4 in FIG. 5) and enters the print command in step S6' (as for step S5 in FIG. 5). Steps S7, S8 and S9 are then performed in the same manner as outlined above for FIG. 5. Following completion of the cutting operation in step S9 control returns to step S4', where the tape is again rewound a predetermined distance. Further labels can then be printed as required.

Figure 7:
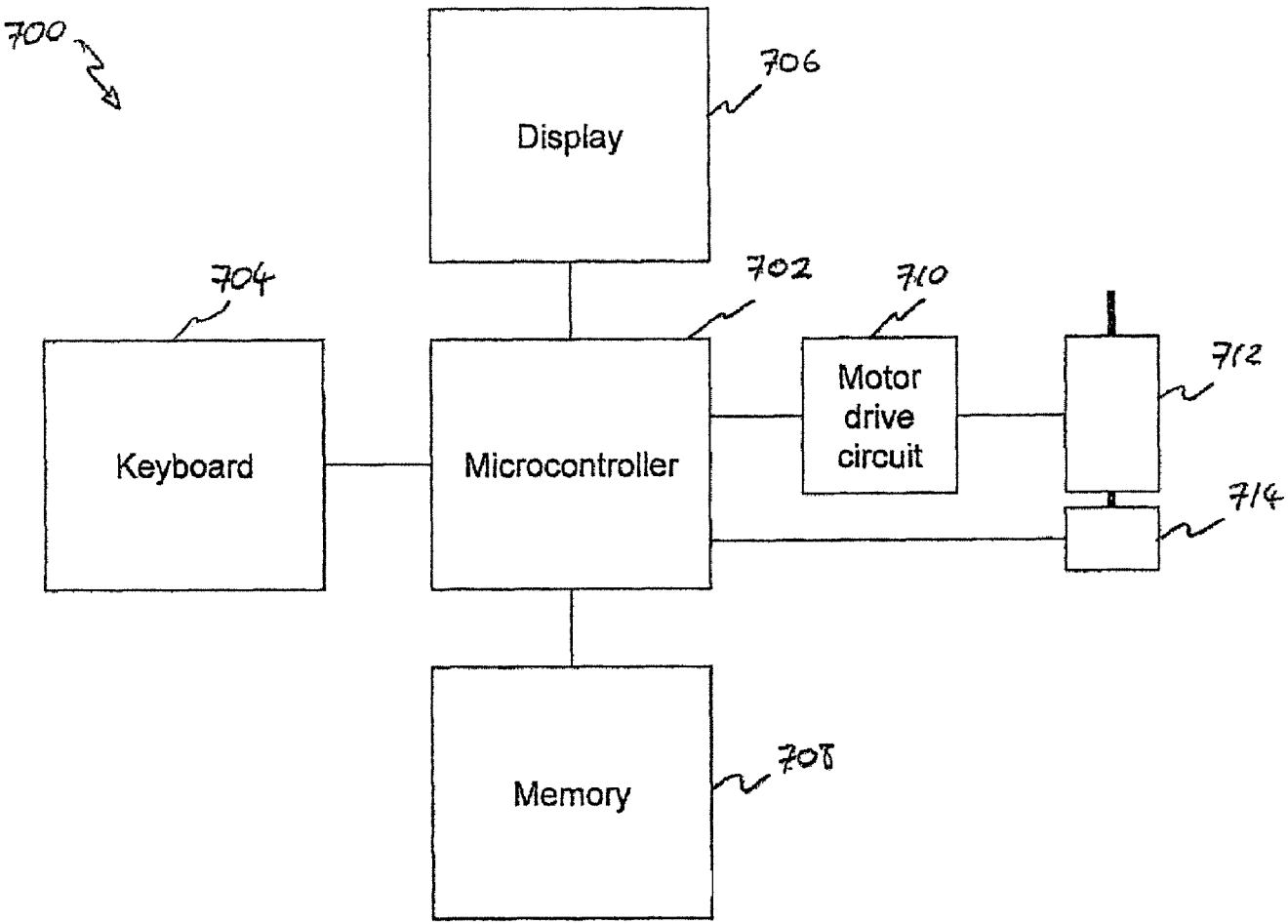
FIG. 7 shows a block diagram of a control system for reverse feeding.

Reference is now made to FIG. 7, which shows a block diagram of a control system 700 used to control a reverse feeding tape printer. The control system 700 comprises a microcontroller 702, which is used to control the operation of the tape printer. The microcontroller 702 is connected to a keyboard 704 or other input means, which is used by the user to input data to the tape printer. For example, the user inputs the message or image to be printed on a label, and can also enter other parameters of the label, such as font sizes and styles. The user may also input data related to the reverse feeding, such as setting a margin size that determines how far the tape should be rewound, as described previously. The microcontroller 702 is also connected to a display means 706, which prompts the user to enter required data, and provides the user with visual feedback on the data that has been entered. The microcontroller 702 is also connected to a memory 708. The memory 708 may be used to store information such as the predetermined rewind distance, or the maximum rewind distance that can be set by the user. The memory 708 can also store the information input by the user, such as the label message or image and required margin sizes.

The driving of the platen 108 is also controlled by the microcontroller 702. The signals to drive the platen (including which direction it should be driven in) are provided from the microcontroller 702 to a motor drive circuit 710. The motor drive circuit 710 provides the higher power signals required to drive the platen motor 712 either forwards or in reverse. However, it is important that the platen motor 714 can be precisely controlled to drive the platen 108, and therefore the image receiving tape 104, a particular distance. Feedback is therefore provided to the microcontroller 702 from a shaft encoder 714 connected to the platen motor 712. This provides the microcontroller 702 with information on the rotation of the platen motor 712, which can be translated into information on how far the image receiving tape 104 has been fed.

The invention claimed is:

1. A printing apparatus comprising:

a receiving area configured to receive a supply of an image receiving medium;

a platen arranged to feed the image receiving medium selectively in one of a forward and reverse direction;

a print head arranged to print an image on the image receiving medium while the medium is fed in the forward direction; and an arcuate guide portion partially encasing the platen and movable relative to the surface of the platen, said guide portion having an inoperative position in which it is spaced from the print head to permit a supply of image receiving medium to be received, and an operative position wherein the guide portion is moved relative to the print head from said inoperative position in which it is spaced from the print head to said operative position in which the guide portion is positioned proximate to the print head, whereby the guide portion in the operative position restricts movement of the image receiving medium in a direction perpendicular to the forward and reverse direction.

2. A printing apparatus according to claim 1, wherein the receiving area comprises a door movable between an open position in which the supply of an image receiving medium can be inserted into the receiving area and a closed position in which the door covers the receiving area.

3. A printing apparatus according to claim 2, wherein the arcuate guide portion is connected to a biasing means arranged to bias the guide portion in the inoperative position.

4. A printing apparatus according to claim 1, wherein the receiving area comprises a cassette receiving bay for receiving a cassette housing image receiving medium.

5. A printing apparatus according to claim 1, wherein the receiving area comprises first and second receiving zones for receiving respectively an image receiving medium holding case and an image transfer ribbon holding case.

6. A printing apparatus comprising:

a receiving area configured to receive a medium holding case;

a medium holding case located in said receiving area and holding a supply of an image receiving medium, the medium holding case having an outlet through which the image receiving medium can be fed out and a recess for accepting a print head;

a platen arranged to feed the image receiving medium selectively in one of a forward and reverse direction;

a print head arranged to print an image on the image receiving medium while the medium is fed in the forward direction; and an arcuate guide portion partially encasing the platen and movable relative to the surface of the platen, said guide portion having an inoperative position in which it is spaced from the print head to permit the medium holding case to be received, and an operative position wherein the guide portion is moved relative to the print head from said inoperative position in which it is spaced from the print head to said operative position in which the guide portion is positioned proximate to the print head, whereby the guide portion in the operative position restricts movement of the image receiving medium in a direction perpendicular to the forward and reverse direction.

7. A printing apparatus according to claim 6, wherein the medium holding case comprises a support member mounted on a wall of the medium holding case and extending inwardly of the recess and aligned with the outlet, whereby said support member supports a leading edge of the image receiving medium to restrict movement of the image receiving medium in a direction perpendicular to the forward direction such that the leading edge of the image receiving medium is located in the outlet when fed forwards.

8. A printing apparatus according to claim 7, wherein the medium holding case holds both a supply of image transfer ribbon and image receiving medium.

9. A printing apparatus according to claim 7, wherein the image receiving medium is a direct thermal medium.

10. A printing apparatus according to claim 7, wherein the image receiving medium is continuous tape.

11. A printing apparatus according to claim 7, wherein the image receiving medium is die-cut labels.

12. A printing apparatus according to claim 7, wherein the medium holding case holds both a supply of image transfer ribbon and image receiving medium, wherein the image receiving medium is continuous tape.

13. A printing apparatus according to claim 7, wherein the medium holding case holds both a supply of image transfer ribbon and image receiving medium, and wherein the image receiving medium is die-cut labels.

14. A printing apparatus according to claim 7, wherein the image receiving medium is a direct thermal medium and wherein the image receiving medium is continuous tape.

15. A printing apparatus according to claim 7, wherein the image receiving medium is a direct thermal medium and wherein the image receiving medium is die-cut labels.

16. A printing apparatus comprising:

a receiving area configured to receive a supply of an image receiving medium;

a platen arranged to feed the image receiving medium selectively in one of a forward and reverse direction;

a print head arranged to print an image on the image receiving medium while the medium is fed in the forward direction; and an arcuate guide portion partially encasing the platen and movable relative to the surface of the platen, said guide portion having an inoperative position in which it is spaced from the print head to permit a supply of image receiving medium to be received, and an operative position wherein the guide portion is moved to be proximate to the print head, whereby the guide portion in the operative position restricts movement of the image receiving medium in a direction perpendicular to the forward and reverse direction, the arcuate guide portion extending substantially the whole length of the platen, and having an edge from which protrudes an extension piece which in the operational position is proximate to the printhead.

17. A printing apparatus comprising:

a receiving area configured to receive a supply of an image receiving medium, wherein the receiving area comprises a door movable between an open position in which the supply of an image receiving medium can be inserted into the receiving area and a closed position in which the door covers the receiving area;

a platen arranged to feed the image receiving medium selectively in one of a forward and reverse direction;

a print head arranged to print an image on the image receiving medium while the medium is fed in the forward direction; and an arcuate guide portion partially encasing the platen and movable relative to the surface of the platen, said guide portion having an inoperative position in which it is spaced from the print head to permit a supply of image receiving medium to be received, and an operative position wherein the guide portion is moved to be proximate to the print head, whereby the guide portion in the operative position restricts movement of the image receiving medium in a direction perpendicular to the forward and reverse direction, the arcuate guide portion comprising a rib mounted on the outside of the guide portion, said rib being arranged to be actuated by the door, whereby moving the door into the closed position moves the arcuate guide portion into the operative position.

18. A printing apparatus comprising:

a receiving area configured to receive a medium holding case;

a medium holding case located in said receiving area and holding a supply of an image receiving medium, the medium holding case having an outlet through which the image receiving medium can be fed out and a recess for accepting a print head;

a platen arranged to feed the image receiving medium selectively in one of a forward and reverse direction;

a print head arranged to print an image on the image receiving medium while the medium is fed in the forward direction; and an arcuate guide portion partially encasing the platen and movable relative to the surface of the platen, said guide portion having an inoperative position in which it is spaced from the print head to permit the medium holding case to be received, and an operative position wherein the guide portion is moved to be proximate to the print head, whereby the guide portion in the operative position restricts movement of the image receiving medium in a direction perpendicular to the forward and reverse direction, the arcuate guide portion extending substantially the whole length of the platen, and having an edge from which protrudes an extension piece which in the operational position is proximate to the printhead.

19. A printing apparatus comprising:

a receiving area configured to receive a medium holding case, wherein the receiving area comprises a door movable between an open position in which the supply of an image receiving medium can be inserted into the receiving area and a closed position in which the door covers the receiving area;

a medium holding case located in said receiving area and holding a supply of an image receiving medium, the medium holding case having an outlet through which the image receiving medium can be fed out and a recess for accepting a print head;

a platen arranged to feed the image receiving medium selectively in one of a forward and reverse direction;

a print head arranged to print an image on the image receiving medium while the medium is fed in the forward direction; and an arcuate guide portion partially encasing the platen and movable relative to the surface of the platen, said guide portion having an inoperative position in which it is spaced from the print head to permit the medium holding case to be received, and an operative position wherein the guide portion is moved to be proximate to the print head, whereby the guide portion in the operative position restricts movement of the image receiving medium in a direction perpendicular to the forward and reverse direction, the arcuate guide portion comprising a rib mounted on the outside of the guide portion, said rib being arranged to be actuated by the door, whereby moving the door into the closed position moves the arcuate guide portion into the operative position.

* * * * *